United States Patent [19]

Leahy

[11] Patent Number: 4,884,718

[45] Date of Patent: Dec. 5, 1989

[54] CONTAINER WITH A RELEASABLE HINGED CLOSURE PANEL AND A FIXED CLOSURE PANEL

[75] Inventor: David J. Leahy, Framingham, Mass.

[73] Assignee: Dennison Manufacturing Company, Framingham, Mass.

[21] Appl. No.: 314,529

[22] Filed: Feb. 23, 1989

Related U.S. Application Data

[63] Continuation-in-part of Ser. No. 684,326, Dec. 20, 1984.

[51] Int. Cl.[4] ..... B65D 43/16

[52] U.S. Cl. ..... 220/339; 206/45.34; 206/470; 206/806; 229/2.5 R

[58] Field of Search ..... 206/461, 470, 806, 215, 206/45.14, 45.31, 45.33, 45.34; 220/334, 335, 337, 339; 229/2.5 R

[56] References Cited

U.S. PATENT DOCUMENTS

| | | | |
|---|---|---|---|
| 2,019,802 | 11/1935 | Sproull | 206/215 |
| 2,088,107 | 7/1937 | Hassenfeld | 220/337 |
| 2,600,927 | 6/1952 | Scoville | 206/215 |
| 2,869,769 | 1/1959 | Robinson | 220/334 X |
| 3,080,087 | 3/1963 | Cloud | 220/339 X |
| 3,412,890 | 11/1968 | Rich | 220/334 X |
| 3,598,301 | 8/1971 | Shaw et al. | 229/2.5 R X |
| 3,776,504 | 12/1973 | Wiley | 229/2.5 R X |
| 3,861,556 | 1/1975 | Bareeled et al. | 206/216 |
| 3,933,296 | 1/1976 | Ruskin et al. | 229/2.5 R |
| 4,202,464 | 5/1980 | Mohs et al. | 220/339 |

FOREIGN PATENT DOCUMENTS

| | | | |
|---|---|---|---|
| 2123469 | 11/1972 | Fed. Rep. of Germany | 220/339 |

*Primary Examiner*—Bryon P. Gehman
*Attorney, Agent, or Firm*—Barry D. Josephs

[57] ABSTRACT

Containers of one piece construction for labels, stick on items and the like. The containers are provided with an integrally molded cover which is easily opened to provide ready access to the contents. The cover is easily closed and automatically relocks to protect unused contents. The containers have an integrally molded planar extension for hanging on a display. The cover locking system readily releases when the cover is opened and easily reengages when the cover is closed.

5 Claims, 7 Drawing Sheets

106(a)
105(a)
80
55
90
92
62
64
52
110
54
84
82
105(b)
106(b)
56
50
60
62
63

CONTAINER WITH A RELEASABLE HINGED CLOSURE PANEL AND A FIXED CLOSURE PANEL

BACKGROUND OF THE INVENTION

This application is a continuation in part of patent application Ser. No. 684,326 filed Dec. 20, 1984.

1. Field of the Invention

This invention relates to containers for labels, stick on items and the like, and particularly to containers having reclosable cover extensions.

2. Description of the Prior Art

Blister packages are commonly used in the display of items for sale. As shown in FIG. 1, a common container 8 includes a rectangular panel of cardboard 14 and a five-sided plastic chamber 12. Tabs 17, which extend from the edges of the chamber, are glued to the cardboard panel forming an enclosure for the items to be contained. The chamber is typically smaller in dimension than the cardboard panel in order that identification markings can be printed on the panel. These containers suffer the disadvantage of requiring assembly. Further, the cardboard backing is subject to moisture decay and is easily dog eared and worn from handling. Additionally, the cardboard panel can warp and curl, particularly when a heavy container is hung from a display hook.

Another display container is as disclosed in U.S. Pat. No. 4,202,464. A clear plastic chamber is formed with an integral chamber sealing member. The contents of the chamber are identified with a label which surrounds and seals the chamber. The container is opened by inserting a knife or fingernail in a groove formed by the mating parts, thus severing the label. A disadvantage of this type of container is that the label is confined in size to the dimensions of the largest face of the chamber. Additionally, the contents of the chamber are at least partially obscured by the label. Moreover, when the chamber is small the label may completely obscure the chamber contents in order to be readable from a distance.

Other prior art container for use in housing sheets of self sticking labels, tabs and the like have the disadvantage that it is typically difficult to access the contents when the container is opened. These prior art containers are also typically of cardboard construction having cardboard closure flaps that tend to wear rapidly on repeated opening and closing. When opened, access to the contents is usually at the container ends which has a narrow access making the container prone to tearing. If access to the contents is through the container body it is difficult to keep the contents from slipping out when the container is jostled or tipped.

SUMMARY OF THE INVENTION

In accomplishing the foregoing and related objects, the invention provides a clear plastic container having an enlarged receiving chamber and integral cover extensions which are reclosable over the receiving chamber.

In accordance with one aspect of the invention, the chamber is sized in accordance with the number of items to be accommodated. A chamber sealing panel or cover extension is provided hingedly extending from the chamber. An elongated planar extension projects from the chamber and can be used for describing the contents of the chamber or for hanging the container on a display rack. The cover extension and planar extensions are integrally molded with the chamber forming a container of one piece construction. The cover is readily opened to provide easy access to the chamber contents. The cover is designed to be manually reclosable over the chamber. In a preferred embodiment, the container is molded from a flexible and clear thermoplastic, such as polyvinylchloride (PVC).

In accordance with another aspect of the invention, the cover extension and elongated planar extension may be provided with embossments or grooves to prevent curling or warping of the extensions. The grooves can also form margins for identification marking on the container.

In accordance with another aspect of the invention a one piece container is provided having a chamber for labels and the like. The container has a novel releasable and relocking cover system. The cover system is composed of a releasable cover panel and a fixed cover panel. The container is of one piece construction so that the cover system is integrally molded with the chamber. The container is typically of translucent plastic material so that the container contents are visible at all times.

The releasable cover panel is secured to the chamber by an integrally molded hinge and has a locking system that enables the panel to lock to the chamber when closed, yet the cover panel is easily opened with only slight manual force. The container provides easy access to the contents therein when the releasable cover panel is opened. The fixed cover panel keeps the container contents typically sheets of self sticking labels from spilling out even if the container is jostled or tipped upside down.

A member extends downwardly from the releasable cover panel. The locking system is formed by the engagement of this downwardly extending member and the lip edge of the fixed cover panel. As the releasable cover panel is closed, the exposed lip edge of the fixed panel first contacts an incline located on an end of the member extending downwardly from the releasable cover panel. The exposed lip edge of the fixed panel passes beyond the incline and comes to a locking position in a groove located immediately above the incline.

The locking system provides automatic locking when the releasable cover panel is closed, but yet becomes easily unlocked to expose the container contents when only slight manual force is applied. The container has the advantage that it provides ready access to the contents, is easily locked and unlocked without resort to external implements, and prevents the contents from slipping or spilling out when the container is opened.

BRIEF DESCRIPTION OF THE DRAWINGS

Other aspects of the invention will become apparent after considering several illustrative embodiments taken in conjunction with the drawings in which.

DETAILED DESCRIPTION

With reference now to FIGS. 1–6, the container 10 of the present invention includes a chamber 18 for holding a number of items, and an integral planar extension 22 upon which may be placed identification markings.

Figure 3:
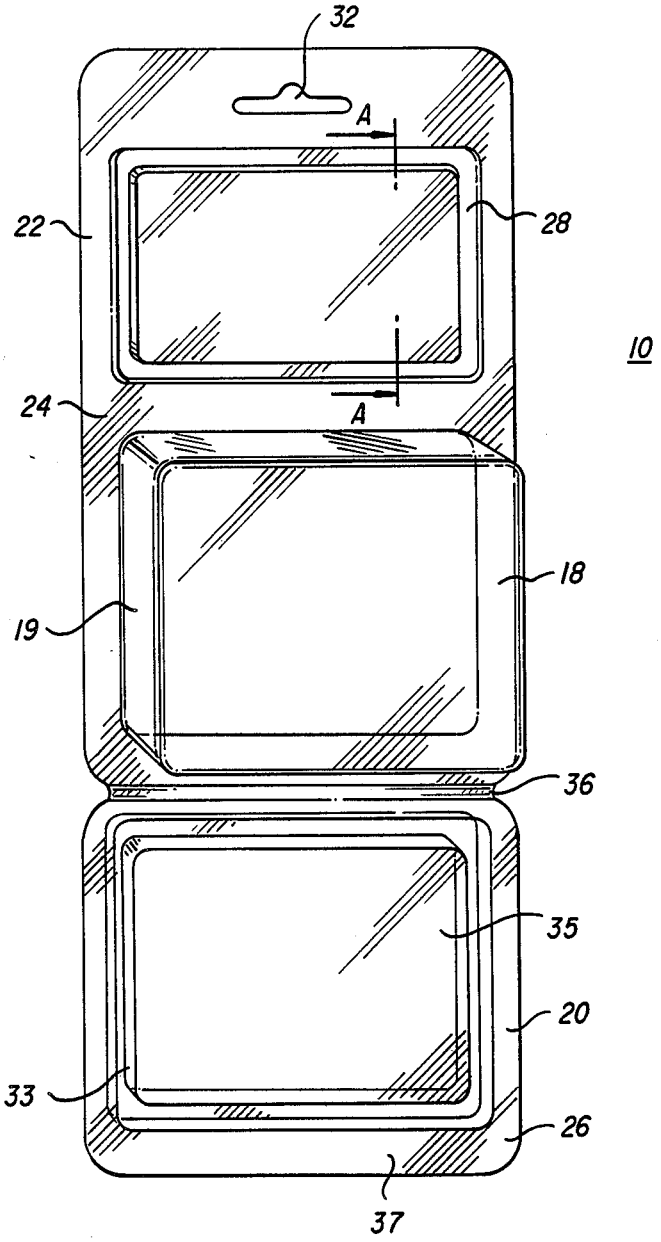
FIG. 3 is a perspective view of the open container of FIG. 2.
Figure 6:
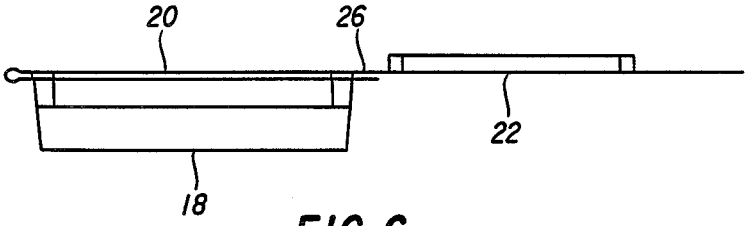
FIG. 6 is a container of the present invention having an elongated tab extending from the chamber sealing member.

In accordance with one embodiment of the invention, a chamber 18 and a chamber sealing cover panel 20 are provided. Cover 20 has an embossed ridge 33 protruding outwardly as shown in FIG. 3. The embossed ridge 33 preferably forms a border defining planar surface 35 of cover 20. As cover 20 is closed along hinge 36, protruding ridge 33 contacts and fits snugly within side walls 19 of chamber 18. There is enough friction between ridge 33 and side walls 19 to keep cover 20 from self opening even when chamber 18 is filled. However, cover 20 may be reopened by manually pulling lip 37 outwardly. The cover 20 may be closed and reopened in this manner dozens of times without causing discernible deterioration in the ability of cover 20 to close snugly over chamber 18. An elongated planar extension 22 is molded as a projection from either the chamber tab 24, as shown in FIG. 3, or the sealing panel tab 26, as shown in FIG. 6. That is, in the embodiment shown in FIG. 3 (or FIG. 4) extension 22 projects and extends from the chamber tab 24; and in the embodiment shown in FIG. 6, extension 22 extends from sealing panel tab 26. The extension 22 thus serves as a securing tab and as an enlarged area upon which may be placed indicia, such as identification markings.

Figure 5:
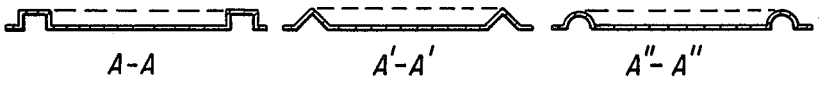
FIG. 5 is a cross sectional view of alternative embossment shapes.
Figure 4:
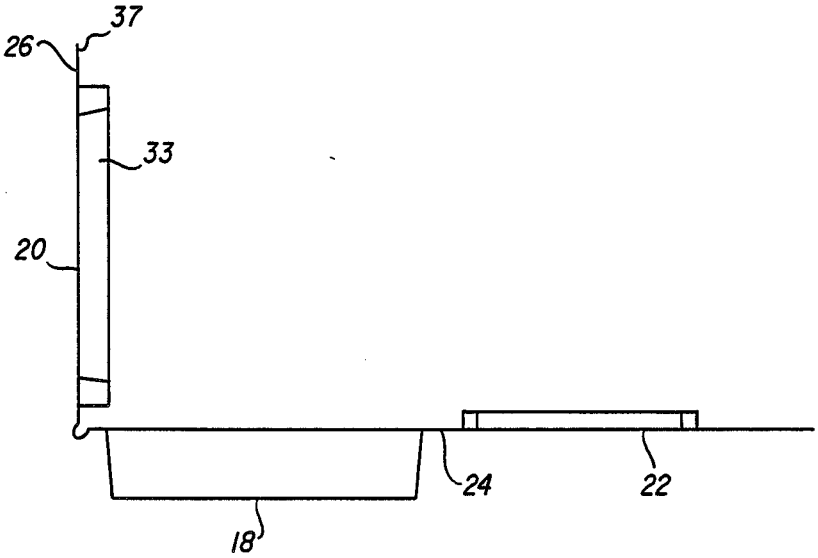
FIG. 4 is a side elevation view of the container of FIG. 2 shown in the open position.

Clear plastic containers for packaging small items are usually constructed with a wall thickness of 0.005 to 0.07 inches, typically 0.01 to 0.03 inches in the preferred embodiments herein. As a result, large unsupported areas tend to deform, for example by warping or curling in changing environmental conditions. Markings on a large flat tab would be difficult to read once the tab curled. To provide an extended region which will maintain a substantially planar conformity, the present invention includes an embossment 28 molded in the surface of extension 22. As shown in FIG. 3, embossment 28 comprises a channel shaped to form a rectangle. As shown in FIG. 5, the embossment A—A is provided with a rectangular cross-section. As A'–A' and A''–A' show, the embossment may be formed with other cross-sectional shapes, such as triangular or semi-circular designs, respectively. Embossment 28 is preferably crimpled in order not to warp or curl the extension. The force required to crimple the embossment 28 is greater than the force imparted to the plastic by normal environmental conditions. Moreover, the embossed extension 22 is sufficiently rigid to withstand rough handling.

Figure 1:
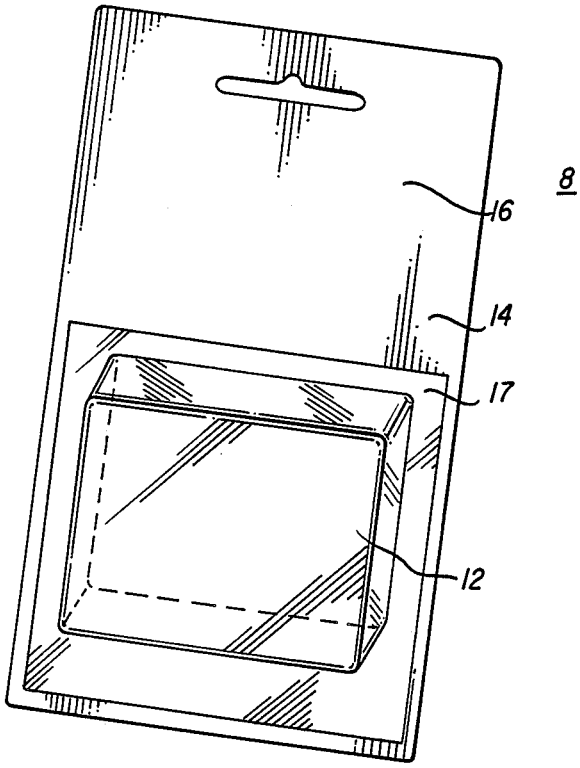
FIG. 1 (PRIOR ART)
FIG. 1 is a perspective view of a container of the prior art.
Figure 2:
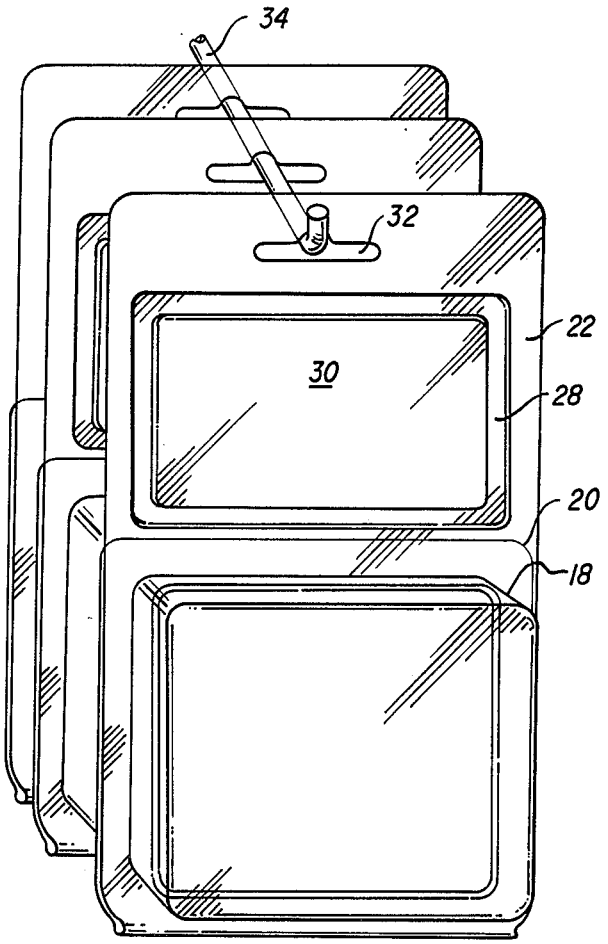
FIG. 2 is a perspective view of the container of the present invention.

Embossment 28 may additionally serve a decorative role. As shown in FIG. 3, by shaping the embossment to form a rectangle, a border is created. As can be seen in FIG. 2, identification markings may be placed within this border, and are thus framed or emphasized. As a result, the markings are conspicuous. This is particularly advantageous where the container is used as a display package for a saleable item. While an adhesive label may be positioned within the border, the embossment formed margin creates a convenient boundary for indicia 30 printed directly on the extension 22.

An aperture 32 may be disposed about the distal end of extension 22. Consequently, the container 10 may be suspended from a hook 34. The aperture is typically centrally located, however, where the center of gravity of the package is asymmetrical, the positioning may be off-center.

It should be understood that the embossed extension 22 of the present invention may be integrally molded with a wide variety of plastic containers, including containers with separate closure members. The extension for such a container may be molded integrally with the chamber or the lid as desired.

Another container embodiment is illustrated in FIGS. 7–10. The container 200 illustrated in FIGS. 7–10 is designed to hold office stationary products such as labels, stick on items, tabs, and the like. Such products typically are in the form of self adhesive labels or tabs which are removable from sheets to which they are releasably secured. Container 200 is composed of a receiving chamber 50 for housing the sheets 110 of labels or tabs and a novel releaseable cover system 120. Chamber 50 is composed of a back panel 52 and side walls 70. Cover system 120 permits easy access to the contents of container 200, but yet container 200 prevents the contents from slipping out when the cover is opened. Container 20 is preferably of translucent plastic material to give visual display of the container contents. Preferred plastic materials for container 200 are polyvinylchloride and rubberized polystyrene, the latter e.g. available under the trademark K-Resin from Phillips Petroleum Co. Although other thermoplastics are suitable the aforementioned plastics are particularly desirable for vacuum forming container 200. Vacuum forming is the preferred method of molding container 200 in a one piece construction. The plastic is typically of about 5 to 25 mils in thickness. Cover system 120 is easily opened and also readily closeable in locking engagement with chamber 50. Container 200 is of integral one piece construction such that cover system 120 is a permanently attached extension to receiving chamber 50.

Figure 8:
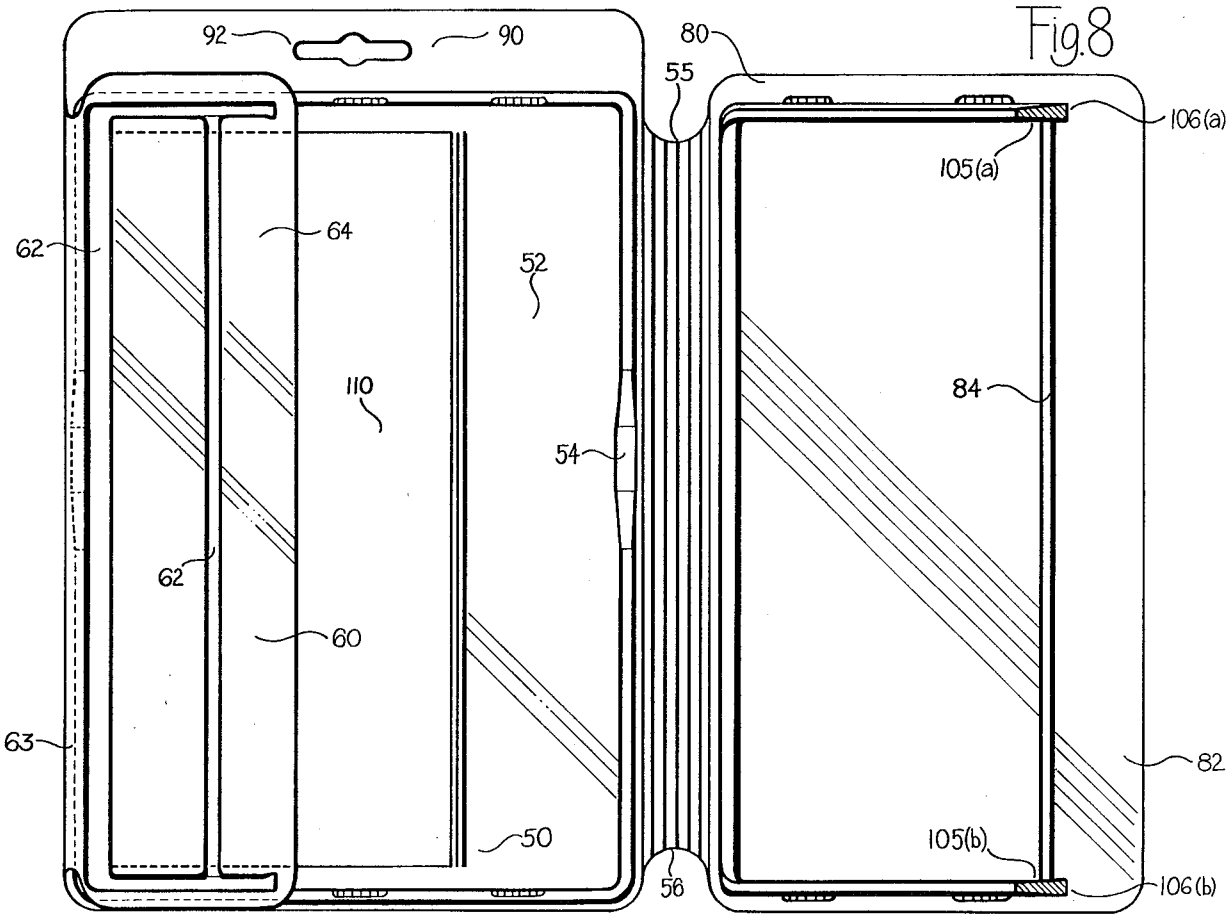
FIG. 8 is a plan view of the container of FIG. 7 in the opened position.

Cover system 120 is formed of a fixed immobilized cover panel 60 and a releasable cover panel 80. The cover panels 60 and 80 ar sufficiently rigid that they do not distort or warp during normal usage and handling. The releasable panel 80 has a overhanging lip 82 which provides a convenient finger grip when it is desired to open cover 80. Cover 80 is provided with a locking mechanism 101 to hold cover 80 in locked engagement with chamber 50 when cover 80 is closed. In use when it is desired to open cover 80, lip 82 is manually gripped and with slight upward force cover 80 becomes unlocked and opened to reveal the contents of chamber 50. The fixed cover panel 60 is R.F. or ultrasonic welded to chamber 50 and thus is immobilized. Fixed cover panel 60 is preferably shorter than releasable cover panel 80. Thus when panel 80 is opened, fixed panel 60 functions to keep sheets or articles 110 within the confines of chamber 50 even if the container is jostled or tipped upside down. Nevertheless when releasable panel 80 is opened as illustrated in FIG. 8, sheets 110 or other contents within chamber 50 become easily accessibly. A finger slot 54 is provided to facilitate access to individual sheets 110 within chamber 50. If it is desired to house very small articles within chamber 50, then it may be advantageous to have fixed cover panel 60 longer than releasable cover panel 80 in order to better hold the articles when cover 80 is opened and the container is tipped.

Figure 7:
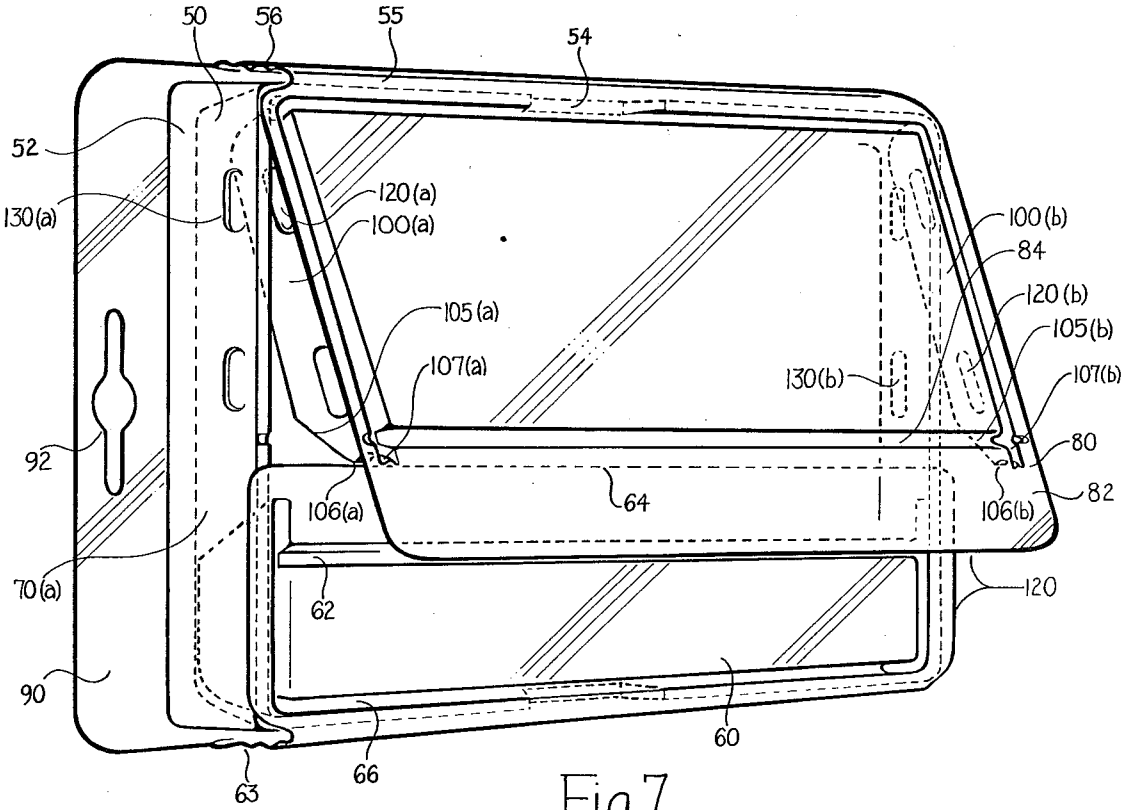
FIG. 7 is a perspective of the container of another embodiment of the invention.
Figure 9:
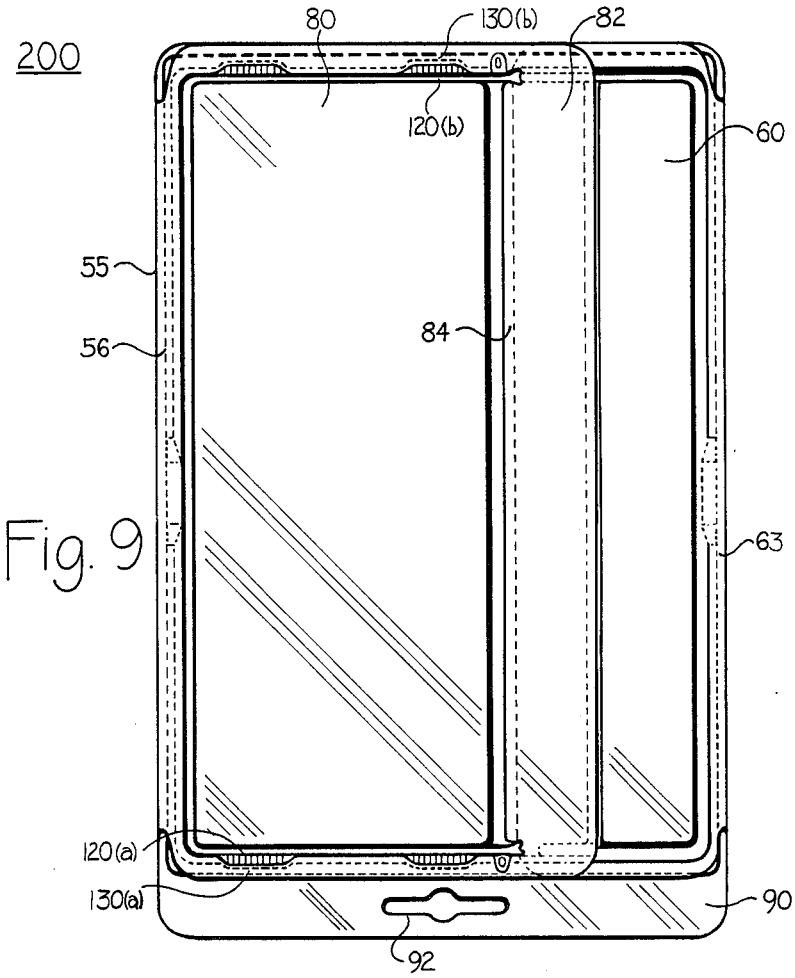
FIG. 9 is a plan view of the container of FIG. 7 in the closed position.

Releasable cover panel 80 is integrally connected to chamber 50 by hinge extension 55. Hinge extension 55 preferably has a plurality of embossed fold lines 56 running along its length. Fold lines 56 reinforce hinge 55 so that there is no discernible weakening of hinge 55 as cover 80 is opened allowing cover 80 to be opened hundreds of times. Cover 80 is preferably provided with a reinforcing groove 84 running at least substantially across its width. Preferably groove 84 runs along the perimeter of cover 80 as illustrated in FIG. 9 to give the cover added reinforcement and prevent warping or curling. Similarly fixed cover panel 60 is provided with a reinforcing groove 62 running along at least a substantial portion of its width as shown in FIG. 8. Fixed cover panel 60 may also be provided with reinforcing grooves 63 to reinforce the container external side wall adjacent fixed cover panel 60. Reinforcing grooves 63 as well as oppositely facing fold lines 56 provide additional structural reinforcement, avoids die cut edges and thus provides the user with a smooth fitting grip. Chamber 50 may be provided with a planar extension 90 which extends from one end of the container as illustrated in FIG. 7. Extension 90 has an aperture 92 so that the container can conveniently be hung on a display rack.

Figure 10:
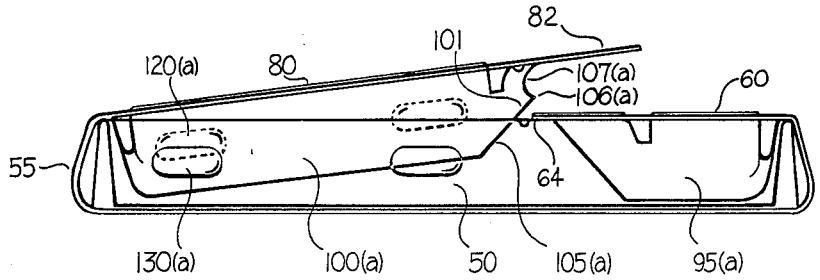
FIG. 10 is an end view of the container of FIG. 7 showing the cover in locked position.

The locking mechanism 101 for releasable cover panel 80 is primarily formed by the engagement of downwardly extending locking panel 100(*a*) and 100(*b*) with lip 64 of fixed panel 60. Downwardly extending panels 100(*a*) and 100(*b*) have an inclined end 105(*a*) and 105(*b*) respectively. The inclined ends 105(*a*) and 105(*b*) terminate at tip 106(*a*) and 106(*b*). As the cover panel 80 is closed, tip 106(*a*) and 106(*b*) engage the edge of lip 64. As further slight downward force is applied to cover 80, the tip 106(*a*) and 106(*b*) slides passed lip edge 64 until lip edge 64 becomes firmly engaged in a groove portion 107(*a*) and 107(*b*) located immediately above the inclines. As shown in FIG. 7 and 10 the grooved portion 107(*a*) and 107(*b*) is located between the incline tip 106(*a*) and 106(*b*), respectively, and the surface of cover panel 80. Additionally extensions 100(*a*) and 100(*b*) have bubble like protrusions 120(*a*) and 120(*b*) which engage mating slots 130(*a*) and 130(*b*) on the inside of chamber 50 side walls. This latter feature augments the locking resulting from engagement of grooves 107(*a*) and 107(*b*) with lip edge 64. This auxiliary locking feature, namely engagement of the bubble like protrusions 120(*a*) and 120(*b*) with slots 130(*a*) and 130(*b*) is optional, since engagement of lip edge 64 with grooves 107(*a*) and 107(*b*) provides sufficiently locking of cover 80. The downwardly extending members 100(*a*) and 100(*b*) also function to provide additional support and reinforcement for the entire container 200 when releasable cover panel 80 is closed. Similarly fixed cover panel 60 is provided with downwardly extending members 95(*a*) and 95(*b*) which give additional support and reinforcement for container 200.

While various aspects of the invention have been set forth by the drawings and the specification, it is to be understood that the foregoing detailed description is for illustration only since various changes in parts, as well as the substitution of equivalent constituents for those shown and described, may be made without departing from the spirit and scope of the invention.

What is claimed:

1. A container of one-piece plastic construction for housing articles such as labels and the like, comprising;

a chamber for the articles, said chamber having an opening on one side for easy access to said articles therein, a relockable cover system extending from opposite ends of said chamber, said cover system being manually releasable to provide access to said articles so that the articles may be easily removed from the chamber, said cover system being reclosable to cover and seal said chamber opening, the cover system comprising a releasable panel and a fixed immobilized panel, the releasable panel being manually closeable over the chamber opening and at least partially covering the fixed panel to seal said chamber opening, the releasable panel in closed position having a lip edge extending over an exposed edge of the fixed panel to seal the chamber opening, and said releasable panel being permanently connected to the chamber by an integrally molded hinge, means integrally molded with said container for relocking the cover system over the chamber opening so that the cover system will not self open after it is closed over the chamber opening, wherein said relocking means functions to lock said releasable panel to the fixed panel so that even if the container is tilted the releasable panel will not self open after it has been closed over the chamber opening, said relocking means comprising a panel extending from the releasable panel in the direction of the chamber opening, said extending panel terminating at one end thereof with an inclined edge and a grooved portion over the incline, so that as the releasable panel is closed over the chamber opening the exposed edge of the fixed panel contacts said incline and thence said exposed edge of the fixed panel engages said grooved portion thereby locking said releasable panel to said fixed panel.

2. A container as in claim 1 wherein the container is molded of transparent plastic material.

3. A container as in claim 1 wherein the releasable panel is larger than the fixed panel.

4. A container as in claim 1 further comprising a planar extension extending from an end of the chamber, said planar extension having an aperture therein for hanging the container on a display rack.

5. A container as in claim 1 wherein the container is comprised of polyvinylchloride plastic.

* * * * *